US010988902B2

(12) United States Patent
Sasaki et al.

(10) Patent No.: US 10,988,902 B2
(45) Date of Patent: Apr. 27, 2021

(54) ARTICLE TRANSPORT FACILITY

(71) Applicants: Taiwan Daifuku Co., Ltd., Tainan (TW); Daifuku Co., Ltd., Osaka (JP)

(72) Inventors: Isamu Sasaki, Hsinchu (TW); Tomohiko Tsuji, Hinocho (JP)

(73) Assignees: Taiwan Daifuku Co., Ltd., Tainan (TW); Daifuku Co., Ltd., Osaka (JP)

( * ) Notice: Subject to any disclaimer, the term of this patent is extended or adjusted under 35 U.S.C. 154(b) by 283 days.

(21) Appl. No.: 16/140,613

(22) Filed: Sep. 25, 2018

(65) Prior Publication Data

US 2019/0093290 A1 Mar. 28, 2019

(30) Foreign Application Priority Data

Sep. 27, 2017 (JP) ..... JP2017-186261

(51) Int. Cl.

| | |
|---|---|
| ***E01B 11/32*** | (2006.01) |
| ***E06B 5/16*** | (2006.01) |
| ***B61B 5/02*** | (2006.01) |
| ***B61B 3/02*** | (2006.01) |

(52) U.S. Cl.

CPC ..... *E01B 11/32* (2013.01); *B61B 3/02* (2013.01); *B61B 5/02* (2013.01); *E06B 5/16* (2013.01); *E05Y 2900/134* (2013.01)

(58) Field of Classification Search

CPC .. B61B 3/00; B61B 3/02; B61B 10/00; B61B 13/00; B61B 13/04; B60L 13/00

See application file for complete search history.

(56) References Cited

U.S. PATENT DOCUMENTS

2017/0002523 A1* 1/2017 Ogisu ..... B61B 3/02

FOREIGN PATENT DOCUMENTS

| | | | | |
|---|---|---|---|---|
| CN | 103159021 A | | 6/2013 | |
| CN | 106315145 A | | 1/2017 | |
| JP | 34717 B2 | | 1/1991 | |
| JP | H 061232 | * | 1/1994 | ..... B60L 13/00 |
| JP | 2006282140 A | | 10/2006 | |

* cited by examiner

*Primary Examiner* — Robert J McCarry, Jr.

(74) *Attorney, Agent, or Firm* — The Webb Law Firm

(57) ABSTRACT

A first adjustment member includes a first adjustment traveling face that forms a traveling face continuous with a first body traveling face, and is arranged so that the first adjustment traveling face at least partially protrudes into a second gap. A second adjustment member includes a second adjustment traveling face forming a traveling face continuous with a second body traveling face, and is arranged so that the second adjustment traveling face at least partially protrudes into the second gap. A gap across which the first adjustment member and the second adjustment member oppose each other is a first gap, and an adjustment mechanism capable of changing the position of the first gap in a direction parallel with a travel path is provided.

18 Claims, 8 Drawing Sheets

ARTICLE TRANSPORT FACILITY

CROSS-REFERENCE TO RELATED APPLICATION

This application claims priority to Japanese Patent Application No. 2017-186261 filed Sep. 27, 2017, the disclosure of which is hereby incorporated in its entirety by reference.

BACKGROUND OF THE INVENTION

1. Field of the Invention

The present invention relates to an article transport facility that includes an article transport vehicle that travels along a travel path passing through an opening portion formed in a wall body, a guide rail for guiding the article transport vehicle along the travel path, and a fire-proof door for closing the opening portion by moving in a direction parallel to a wall face of the wall body.

2. Description of the Related Art

As an example of the aforementioned article transport facility, JP H3-4717B (Patent Document 1) discloses a technique for avoiding interference between a fire-proof door installed at an opening portion in a fire protection area of a building and guide rails that constitute a travel path for an article transport vehicle, in a case where the guide rail penetrates the fire protection area. In this technique in Patent Document 1, gaps through which the fire-proof door can pass are formed in a pair of left and right guide rails. In case of fire, the fire-proof door is passed through the gap so that the opening portion can be closed.

Here, to minimize vibrations and impacts occurring when the article transport vehicle travels in the gap portions in the guide rails, it is desirable to make the gaps for allowing the fire-proof door to pass as small as possible. However, in a case where the gaps in the guide rails are made small, if the guide rails move due to swaying during an earthquake, or due to aging as a result of traveling and acceleration/deceleration thereon of the article transport vehicle, there is a possibility that the positions of the gaps in the guide rails are shifted from the position of the fire-proof door, and the fire-proof door cannot be closed when fire occurs. For this reason, a regular check needs to be made to adjust the gap positions. Meanwhile, to move the gap positions, operations need to be performed to temporarily loosen the fixation of the guide rails to finely adjust the positions thereof, and then fix them again, requiring a lot of time and effort.

SUMMARY OF THE INVENTION

Realization of a technique is desired that makes it possible to readily adjust the positions or width of the gaps in the guide rails for allowing the fire-proof door to pass.

An article transport facility according to this disclosure includes:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein a first gap through which the fire-proof door can pass is provided in the guide rail, the guide rail includes a first rail body portion and a second rail body portion that are arranged separately on respective sides in a direction parallel to the travel path with a second gap therebetween, the second gap being larger than the first gap, and also includes a first adjustment member attached to the first rail body portion, and a second adjustment member attached to the second rail body portion, the first rail body portion includes a first body traveling face on which a traveling wheel of the article transport vehicle rolls, the second rail body portion includes a second body traveling face on which a traveling wheel of the article transport vehicle rolls, the first adjustment member includes a first adjustment traveling face forming a traveling face continuous with the first body traveling face, and is arranged so that the first adjustment traveling face at least partially protrudes into the second gap, the second adjustment member includes a second adjustment traveling face forming a traveling face continuous with the second body traveling face, and is arranged so that the second adjustment traveling face at least partially protrudes into the second gap, a gap across which the first adjustment member and the second adjustment member oppose each other is the first gap, and an adjustment mechanism capable of changing the position of the first gap in the direction parallel to the travel path is provided.

With this configuration, the gap across which the first rail body portion and the second rail body portion oppose each other is the second gap that is larger than the first gap through which the fire-proof door passes, and the position of the first gap can be changed in the direction parallel to the travel path within the area of the second gap by the adjustment mechanism. Since this adjustment using the adjustment mechanism is an adjustment of the position of the gap across which the first adjustment member and the second adjustment member oppose each other, the positions of the first rail body portion and the second rail body portion do not need to be moved. Accordingly, the position of the first gap in the guide rail through which the fire-proof door passes can be readily adjusted. Also, since the first adjustment traveling face of the first adjustment member and the second adjustment traveling face of the second adjustment member are arranged protruding into the second gap, the gap in the traveling face of the guide rail at the portion of the first gap can be made relatively small. Accordingly, it is possible to suppress the occurrence of vibrations and impacts when the article transport vehicle passes through the portion of the first gap, without preventing movement of the fire-proof door.

An article transport facility according to this disclosure includes:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein a first gap through which the fire-proof door can pass is provided in the guide rail, the guide rail includes a first rail body portion and a second rail body portion that are arranged separately on respective sides in a direction parallel to the travel path with a second gap therebetween, the second gap being larger than the first gap, and also includes a first adjustment member attached to the first rail body portion, the first rail body portion includes a first body traveling face on which a traveling wheel of the article transport vehicle rolls, the second rail body portion includes a second body traveling face on which a traveling wheel of the article transport vehicle rolls, the first adjustment member includes a first adjustment traveling face forming a traveling face continuous with the first body traveling face, and is arranged so that the first adjustment traveling face at least partially protrudes into the second gap, a gap across which the first adjustment member and the second rail body portion oppose each other is the first gap, and an adjustment mechanism capable of changing the width of the first gap in the direction parallel to the travel path is provided.

With this configuration, the gap across which the first rail body portion and the second rail body portion oppose each other is the second gap that is larger than the first gap through which the fire-proof door passes, and the width of the first gap can be changed in the direction parallel to the travel path within the area of the second gap by the adjustment mechanism. Since this adjustment using the adjustment mechanism is an adjustment of the width of the gap across which the first adjustment member and the second rail body portion oppose each other, the position of the first rail body portion does not need to be moved. Accordingly, the width of the first gap in the guide rail through which the fire-proof door passes can be readily adjusted. Also, since the first adjustment traveling face of the first adjustment member is arranged protruding into the second gap, the gap in the traveling face of the guide rail at the portion of the first gap can be made relatively small. Accordingly, it is possible to suppress the occurrence of vibrations and impacts when the article transport vehicle passes through the portion of the first gap, without preventing movement of the fire-proof door.

DETAILED DESCRIPTION OF PREFERRED EMBODIMENTS

Hereinafter, embodiments of an article transport facility according to the present invention will be described with reference to the drawings.

1. First Embodiment

Figure 1:
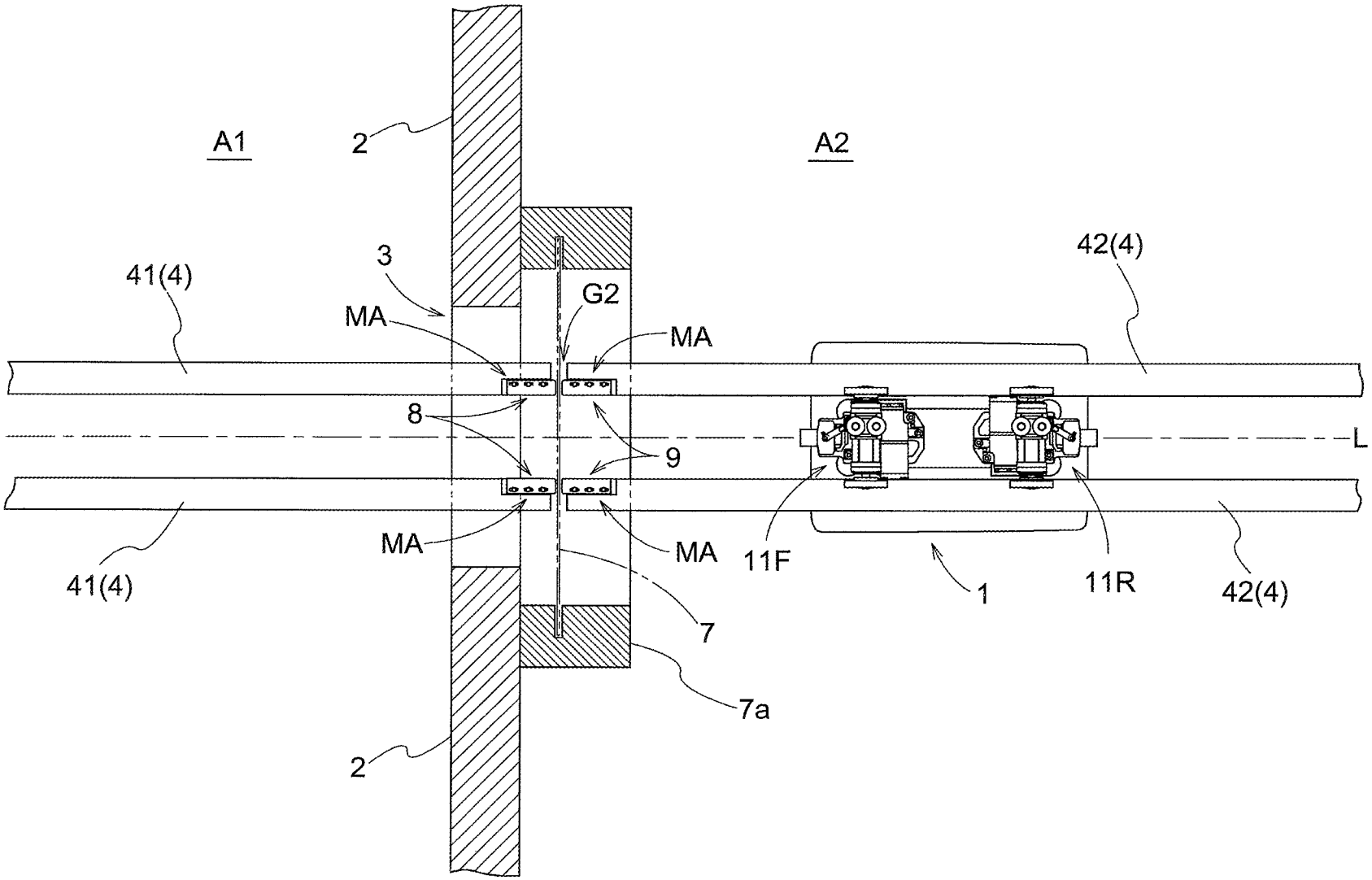
FIG. 1 is a plan view of a main part of an article transport facility.
Figure 2:
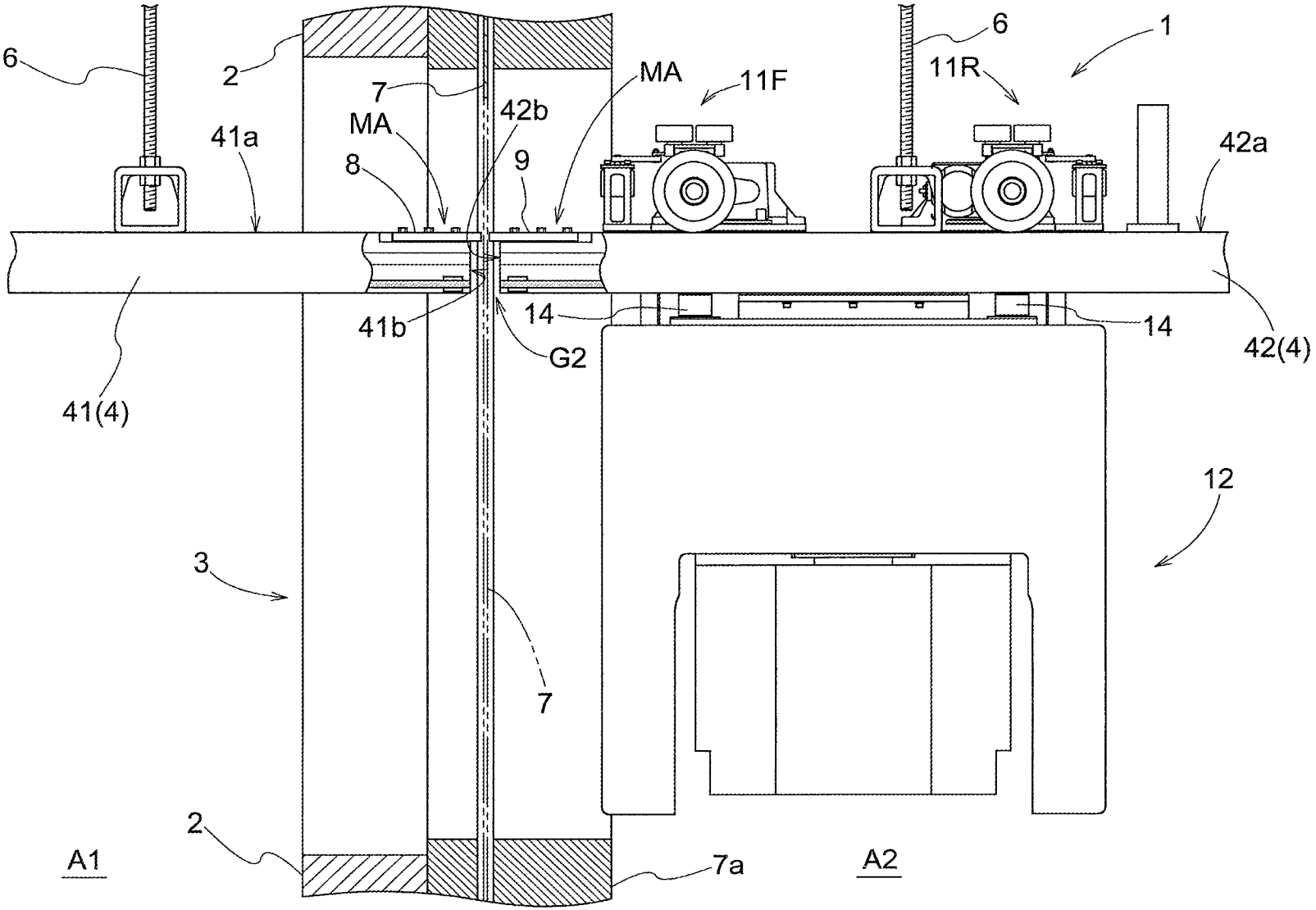
FIG. 2 is a side view of a main part of an article transport vehicle and an area where a door is installed.
Figure 3:
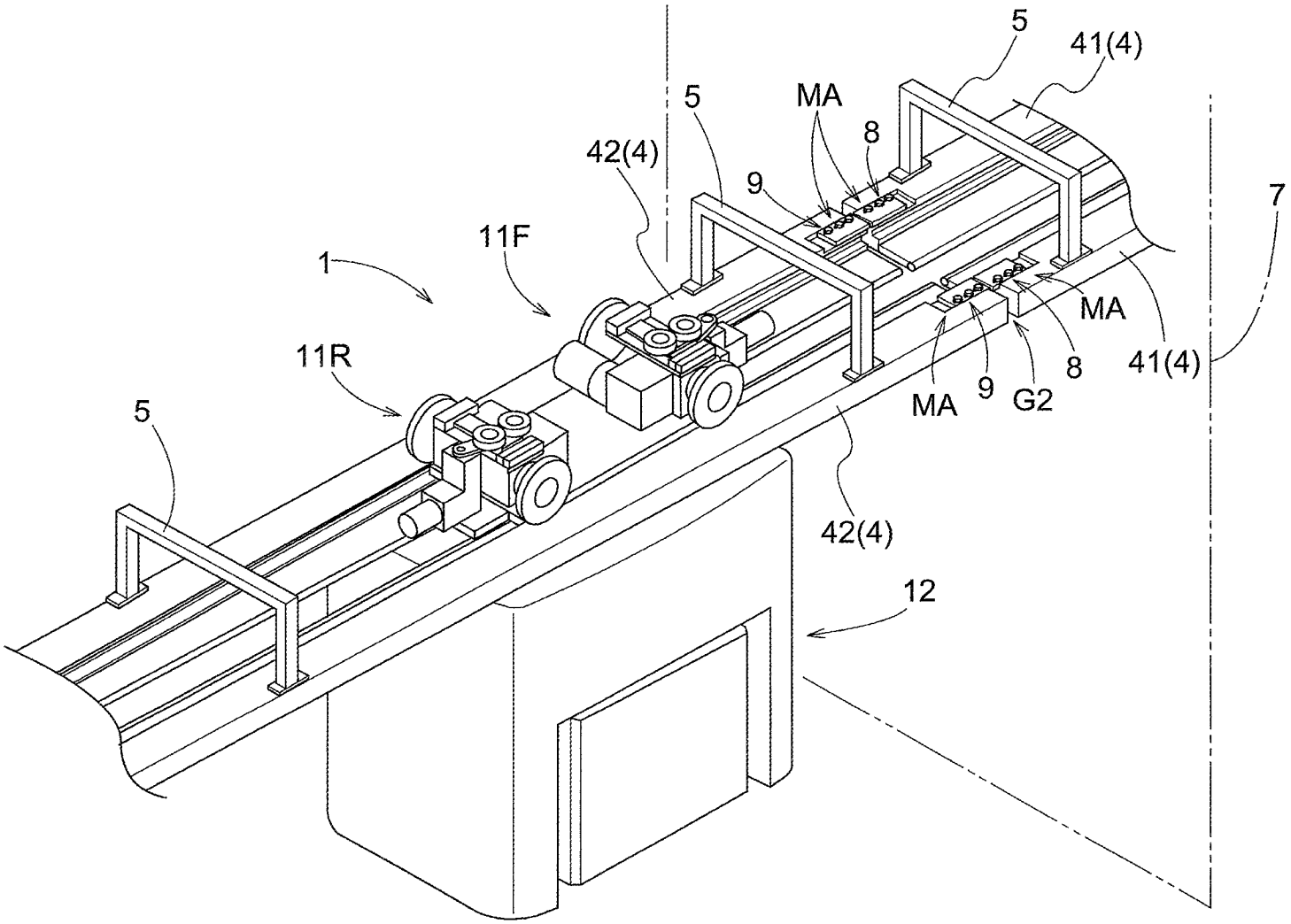
FIG. 3 is a perspective view of a main part of the article transport vehicle and the area where the door is installed.

As shown in FIGS. 1 to 3, the article transport facility includes an article transport vehicle 1 that travels along a travel path L, which passes through an opening portion 3 formed in a wall body 2, guide rails 4 for guiding the article transport vehicle 1 along the travel path L, and a fire-proof door 7 for closing the opening portion 3 by moving in a direction parallel to a wall face of the wall body 2.

The article transport vehicle 1 includes a traveling portion 11 that travels on and along the guide rails 4, which are suspended from a ceiling and is thus supported, a vehicle body portion 12 that is located below the guide rails 4 and is supported by the traveling portion 11 in a suspended manner, and connecting portions 14 that connect the traveling portion 11 to the vehicle body portion 12. The vehicle body portion 12 includes a support portion 13 for supporting an article to be transported in a suspending manner. In this embodiment, a FOUP (Front Opening Unified Pod) for accommodating a semiconductor substrate is an article to be transported.

The traveling portion 11 has a front traveling portion 11F and a rear traveling portion 11R, which are arranged in a vehicle body front-rear direction.

The vehicle body portion 12 is connected to the pair of front and rear connecting portions 14 so as to be able to rotate around vertical axes thereof. The front traveling portion 11F and the rear traveling portion 11R integrally rotate with the connecting portions 14 to which the front and rear traveling portions 11F and 11R are connected respectively, around the vertical axes of the respective connecting portions 14. The pair of front and rear connecting portions 14 is located between the pair of left and right guide rails 4.

Figure 4:
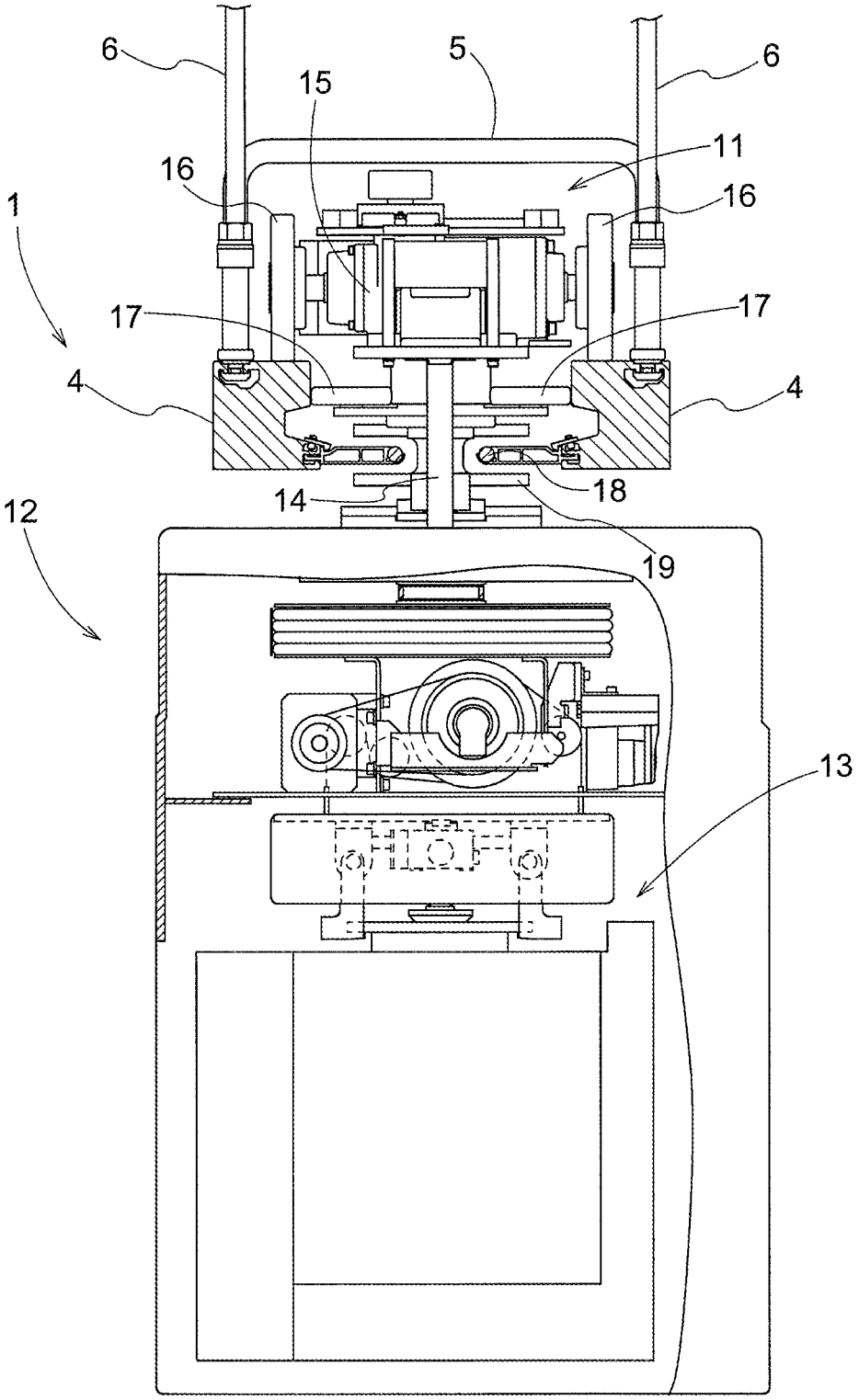
FIG. 4 is a front elevational view of the article transport vehicle.

As shown in FIG. 4, the front traveling portion 11F is equipped with a pair of left and right traveling wheels 16, which are driven to rotate by an electric drive motor 15, so that the traveling wheels 16 travel while rolling on traveling faces formed on upper faces of the pair of left and right guide rails 4. The front traveling portion 11F is also equipped with a pair of left and right guide wheels 17, which freely rotate around axes (around vertical axes) parallel to a vehicle body vertical direction so that the guide wheels 17 come into contact with inner faces of the pair of left and right guide rails 4. The front traveling portion 11F is equipped with two pairs of left and right guide wheels 17 in a state of being arranged in the vehicle body front-rear direction.

The rear traveling portion 11R is equipped with a pair of left and right traveling wheels 16 and two pairs of left and right guide wheels 17, similarly to the front traveling portion 11F.

Thus, the article transport vehicle 1 includes the pairs of left and right traveling wheels 16, and each of the pair of left and right guide rails 4 has a traveling face on which the traveling wheels 16 of the article transport vehicle 1 roll.

A power receiving portion 19, which contactlessly receives a supply of driving power from power supply lines 18 that are installed along the pair of left and right guide rails 4, is provided on the upper face of the vehicle body portion 12. This power receiving unit 19 is located between the pair of front and rear connecting portions 14 in the vehicle body front-rear direction, and is located between the pair of left and right guide rails 4.

The article transport vehicle 1 travels along the guide rails 4 as a result of the traveling wheels 16 of the front traveling portion 11F and the rear traveling portion 11R being driven to rotate, with the position in a vehicle body lateral width direction being restricted as a result of the guide wheels 17 of the front traveling portion 11F and the rear traveling portion 11R being guided by the pair of left and right guide rails 4.

As shown FIG. 4, the pair of left and right guide rails 4 are connected to a rail connecting member 5, which is formed in an inversed U shape when seen in a path length direction, and is supported by the ceiling portion while being suspended therefrom via rail support members 6.

The thus-configured article transport facility spans a first area A1 and a second area A2, as shown in FIGS. 1 and 2. Both the first area A1 and second area A2 are set in a clean room.

The wall body 2, which partitions the first area A1 from the second area A2 and in which the opening portion 3 corresponding to the travel path L for the article transport vehicle 1 is formed, a fire-proof door 7 for opening and closing this opening portion 3, and a frame body 7*a*, which is provided at a periphery of the opening portion 3, are provided in a boundary area between the first area A1 and the second area A2. The fire-proof door 7 moves along the wall face of the wall body 2 while being guided by the frame body 7*a*, and thus can freely move between a closed position (broken line portion in FIG. 2) at which the fire-proof door 7 closes the opening portion 3 and an open position (solid line portion in FIG. 2) at which the fire-proof door 7 opens the opening portion 3. In this embodiment, the fire-proof door 7 moves in the vertical direction along the wall face of the wall body 2. However, this may not always be the case, and the fire-proof door 7 may alternatively move in the left-right direction (horizontal direction) along the wall face of the wall body 2. Thus, the article transport facility includes the fire-proof door 7 that closes the opening portion 3 by moving along the wall face of the wall body 2.

Since the pair of left and right guide rails 4 has a horizontally symmetrical configuration in this embodiment, only one of the guide rails 4 will be described below, and a description of the other guide rail 4 is omitted.

As shown in FIG. 1, the guide rail 4 includes a first rail body portion 41 and a second rail body portion 42 that are arranged on respective sides in a direction parallel to the travel path L, with a cut-off portion G2 therebetween, and also includes a first adjustment member 8 that is attached to the first rail body portion 41 and a second adjustment member 9 that is attached to the second rail body portion 42.

Figure 5:
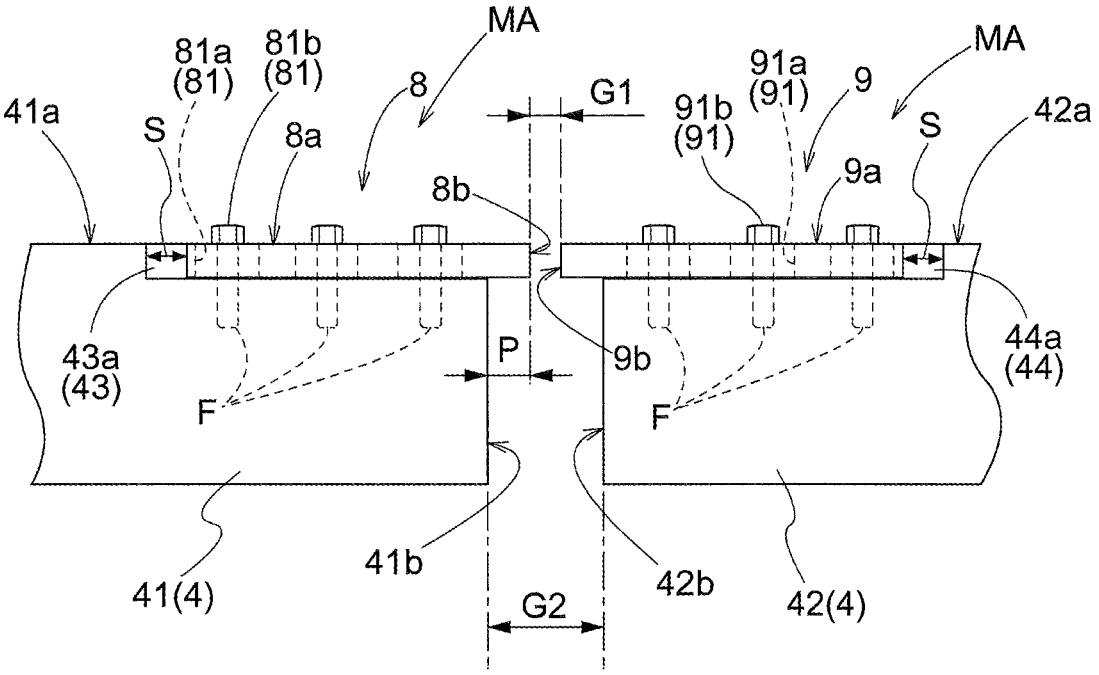
FIG. 5 is an enlarged side view of a main part of an area around a first gap.
Figure 6:
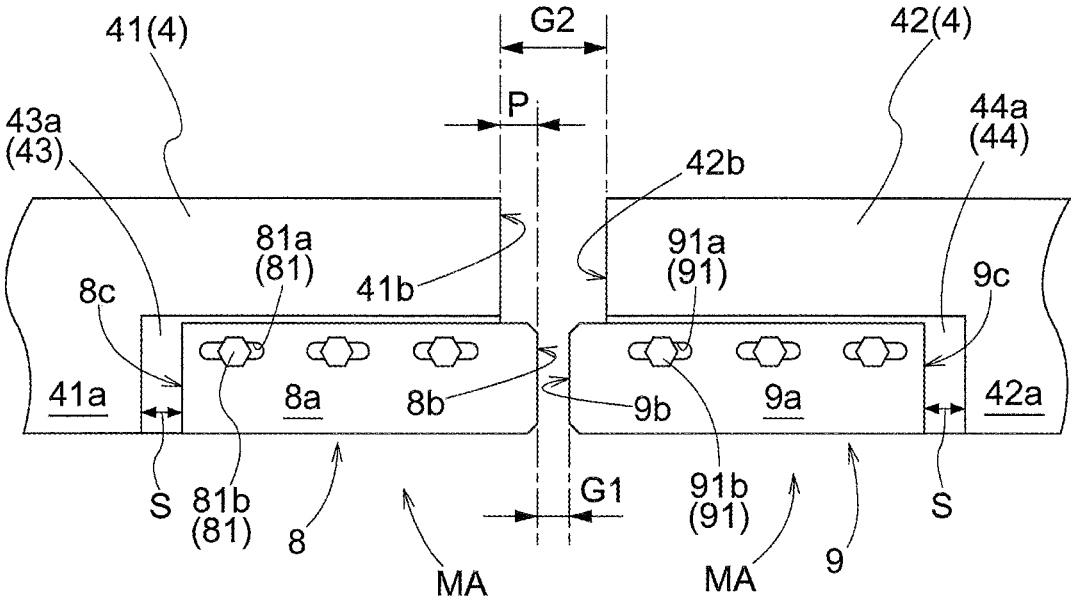
FIG. 6 is an enlarged plan view of a main part of the area around the first gap.

As shown in FIGS. 5 and 6, the first rail body portion 41 includes a first body traveling face 41*a* on which a corresponding traveling wheel 16 of the article transport vehicle 1 rolls, and a first end face 41*b* that faces the cut-off portion G2. The second rail body portion 42 includes a second body traveling face 42*a* on which the traveling wheel 16 of the article transport vehicle 1 rolls, and a second end face 42*b* that faces the cut-off portion G2.

The first adjustment member 8 has a first adjustment traveling face 8*a* that forms a traveling face continuous with the first body traveling face 41*a*, and a first adjustment end face 8*b* that faces a gap portion G1. The first adjustment member 8 is arranged so that the first adjustment traveling face 8*a* protrudes, at least partially, into the cut-off portion G2 by a predetermined protruding amount P. The second adjustment member 9 has a second adjustment traveling face 9*a* that forms a traveling face continuous with the second body traveling face 42*a*, and a second adjustment end face 9*b* that faces the gap portion G1. The second adjustment member 9 is arranged so that the second adjustment traveling face 9*a* protrudes, at least partially, into the cut-off portion G2 by a predetermined protruding amount P.

The gap portion G1 across which the first adjustment end face 8*b* of the first adjustment member 8 and the second adjustment end face 9*b* of the second adjustment member 9 oppose each other corresponds to the "first gap". The cut-off portion G2 across which the first end face 41*b* of the first rail body portion 41 and the second end face 42*b* of the second rail body portion 42 oppose each other corresponds to the "second gap". The width of the cut-off portion G2 in the direction parallel to the travel path L is greater than the width of the gap portion G1 in the direction parallel to the travel path L. The fire-proof door 7, which has a plate shape, can pass through the gap portion G1. More specifically, the width of the gap portion G1 has a length that is obtained by adding a predetermined margin length to the thickness of the fire-proof door 7 in the direction parallel to the travel path L.

In this embodiment, both the first adjustment member 8 and the second adjustment member 9 are rectangular plate-shaped members with a fixed thickness.

The first rail body portion 41 includes a first attachment portion 43 to which the first adjustment member 8 is attached. The first attachment portion 43 includes a first recessed portion 43*a* that is formed in a face of the first rail body portion 41 in which the first body traveling face 41*a* is formed, the first recessed portion 43*a* being rectangular when seen in a plan view. In this example, the face of the first rail body portion 41 in which the first body traveling face 41*a* is formed is an upper face of the first rail body portion 41. The first recessed portion 43*a* is recessed from this face in a thickness direction (here, a downward direction) of the first rail body portion 41. Accordingly, the first recessed portion 43*a* is open in the face in which the first body traveling face 41*a* is formed. Also, the first recessed portion 43*a* is open at least toward the cut-off portion G2. As in this embodiment, the first recessed portion 43*a* may also be open toward a side face of the first rail body portion 41 on one side in the width direction thereof.

The depth of the first recessed portion 43*a* is the same as the thickness of the first adjustment member 8. For this reason, the first adjustment traveling face 8*a* is located in the same plane as that of the first body traveling face 41*a* by arranging the first adjustment member 8 within the first recessed portion 43*a* so that the thickness direction of the first adjustment member 8 coincides with the depth direction of the first recessed portion 43*a*. Also, in this embodiment, the entire face of the first adjustment member 8 that is continuous with the first body traveling face 41*a* (here, the upper face of the first adjustment member 8) serves as the first adjustment traveling face 8*a*. Thus, as a result of the first adjustment member 8 being arranged so as to partially protrude into the cut-off portion G2, the first adjustment traveling face 8*a* is arranged so as to partially protrude into the cut-off portion G2.

The second rail body portion 42 has a second attachment portion 44 to which the second adjustment member 9 is attached. The second attachment portion 44 has a second recessed portion 44*a* that is formed in a face of the second rail body portion 42 in which the second body traveling face 42*a* is formed, the second recessed portion 44*a* being rectangular when seen in a plan view. In this example, the face of the second rail body portion 42 in which the second body traveling face 42*a* is formed is an upper face of the second rail body portion 42. The second recessed portion 44*a* is recessed from this face in a thickness direction (here, downward direction) of the second rail body portion 42. Accordingly, the second recessed portion 44*a* is open in the face in which the second body traveling face 42*a* is formed. Also, the second recessed portion 44*a* is open at least toward the cut-off portion G2. As in this embodiment, the second recessed portion 44*a* may also be open toward a side face of the second rail body portion 42 on one side in the width direction thereof.

The depth of the second recessed portion 44*a* is the same as the thickness of the second adjustment member 9. For this reason, the second adjustment traveling face 9*a* is located in the same plane as that of the second body traveling face 42*a* by arranging second adjustment member 9 within the second recessed portion 44*a* so that the thickness direction of the second adjustment member 9 coincides with the depth direction of the second recessed portion 44*a*. Also, in this embodiment, the entire face of the second adjustment member 9 that is continuous with the second body traveling face 42*a* (here, the upper face of the second adjustment member 9) serves as the second adjustment traveling face 9*a*. Thus, as a result of the second adjustment member 9 being arranged so as to partially protrude into the cut-off portion G2, the second adjustment traveling face 9*a* is arranged so as to partially protrude into the cut-off portion G2.

The article transport facility is also provided with an adjustment mechanism MA that enables the position of the gap portion G1 to be changed in the direction parallel to the travel path L. The adjustment mechanism MA according to this embodiment includes a first position adjustment portion 81 that makes it possible to change the position at which the first adjustment member 8 is attached to the first attachment portion 43, and a second position adjustment portion 91 that makes it possible to change the position at which the second adjustment member 9 is attached to the second attachment portion 44.

The first position adjustment portion 81 includes elongated holes 81*a* that are provided in the first adjustment member 8, and fastening members 81*b*, such as bolts, that are inserted into the elongated holes 81*a*. In this embodiment, a plurality of (here, three) elongated holes 81*a* are located at positions closer to one end side of the first adjustment member 8 in the width direction, and are arranged in a direction parallel to the longitudinal direction of the first adjustment member 8. The number of the elongated holes 81*a* is not limited to three. Each elongated hole 81*a* penetrates the first adjustment member 8 in the thickness direction thereof, and is elongated in the direction parallel to the longitudinal direction of the first adjustment member 8. Of the face of the first adjustment member 8 that is continuous with the first body traveling face 41*a* (here, the upper face of the first adjustment member 8), a portion where the elongated holes 81*a* are not provided serves as the first adjustment traveling face 8*a*.

The second position adjustment portion 91 includes elongated holes 91*a* that are provided in the second adjustment member 9, and fastening members 91*b*, such as bolts, that are inserted into the elongated holes 91*a*. In this embodiment, a plurality of (here, three) elongated holes 91*a* are located at positions closer to one end side of the second adjustment member 9 in the width direction, and are arranged in a direction parallel to the longitudinal direction of the second adjustment member 9. The number of the elongated holes 91*a* is not limited to three. Each elongated hole 91*a* penetrates the second adjustment member 9 in the thickness direction thereof, and is elongated in the direction parallel to the longitudinal direction of the second adjustment member 9. Of the face of the second adjustment member 9 that is continuous with the second body traveling face 42*a* (here, the upper face of the second adjustment member 9), a portion where the elongated holes 91*a* are not provided serves as the second adjustment traveling face 9*a*.

Internal thread portions F, into which the fastening members 81*b* can be threaded, are formed in a bottom face of the first recessed portion 43*a*. These internal thread portions F are provided at positions corresponding to the positions of the elongated holes 81*a* in the first adjustment member 8 that is arranged in the first recessed portion 43*a*. That is to say, the same number of internal thread portions F as the number of elongated holes 81*a* in the first adjustment member 8 is provided in the first recessed portion 43*a*. Also, internal thread portions F, into which the fastening members 91*b* can be threaded, are formed in a bottom face of the second recessed portion 44*a*. These internal thread portions F are provided at positions corresponding to the positions of the elongated holes 91*a* in the second adjustment member 9 that is arranged in the second recessed portion 44*a*. That is to say, the same number of internal thread portions F as the number of elongated holes 91*a* in the second adjustment member 9 is provided in the second recessed portion 44*a*.

As described above, the first adjustment member 8 is fastened and fixed to the first recessed portion 43*a* as a result of the fastening members 81*b* being inserted into the respective elongated holes 81*a*, and a leading end portion of each fastening member 81*b* being threaded into a corresponding internal thread portion F of the first recessed portion 43*a*. The second adjustment member 9 is fastened and fixed to the second recessed portion 44*a* as a result of the fastening members 91*b* being inserted into the respective elongated holes 91*a*, and a leading end portion of each fastening member 91*b* being threaded into a corresponding internal thread portion F of the second recessed portion 44*a*.

When the position of the gap portion G1 is changed by means of the function of the adjustment mechanism MA, first, the fastening of the fastening members 81*b* of the first position adjustment portion 81 is loosened. Then, the first adjustment member 8 is slid in the direction parallel to the travel path L, thereby changing the protruding amount P relative to the cut-off portion G2. Thereafter, the first adjustment member 8 is fixed by fastening the fastening members 81*b* again. Next, the fastening of the fastening members 91*b* of the second position adjustment portion 91 is loosened. Then, the second adjustment member 9 is slid in the same direction as the direction in which the first adjustment member 8 is moved and by the same distance as the distance by which the first adjustment member 8 is moved, thereby changing the protruding amount P relative to the cut-off portion G2. Thereafter, the second adjustment member 9 is fixed by fastening the fastening members 91*b* again.

Accordingly, according to this embodiment, the position of the gap portion G across which the first adjustment member 8 and the second adjustment member 9 oppose each other can be freely adjusted by changing the protruding amount P of the first adjustment member 8, i.e. the amount P by which the first adjustment member 8 protrudes into the cut-off portion G2, and the protruding amount P of the second adjustment member 9, i.e. the amount P by which the second adjustment member 9 protrudes into the cut-off portion G2, using the adjustment mechanism MA. For this reason, the position of the gap portion G1 in the guide rail 4 through which the fire-proof door 7 passes can be readily adjusted, without a need to move the positions of the first rail body portion 41 and the second rail body portion 42.

In this embodiment, gaps S for position adjustment are provided between a rear end face 8*c*, which is an end face of the first adjustment member 8 on the side opposite to the first adjustment end face 8*b*, and a wall face of the first recessed portion 43*a* that opposes the rear end face 8*c*, and between a rear end face 9*c*, which is an end face of the second adjustment member 9 on the side opposite to the second adjustment end face 9*b*, and a wall face of the second recessed portion 44*a* that opposes the rear end face 9*c*. Here, it is favorable that the length of each of the gaps S in the direction parallel to the travel path L is set to a minimum length required to adjust the position of the gap portion G1. It is thus possible to suppress the occurrence of vibrations or impacts when the article transport vehicle 1 passes through the portions of these gaps S. In the configuration in which these gaps S are provided as well, the first adjustment traveling face 8*a* forms a traveling face continuous with the first body traveling face 41*a*, and the second adjustment traveling face 9*a* forms a traveling face continuous with the second body traveling face 42*a*. That is to say, it is defined as the first adjustment traveling face 8*a* of the first adjustment member 8 that forms a traveling face continuous with the first body traveling face 41*a* being not only provided so that no gap S is present between the first body traveling face 41*a* and the first adjustment traveling face 8*a*, but may also be provided so that a gap S on which the article transport vehicle 1 can travel is provided between the first body traveling face 41*a* and the first adjustment traveling face 8*a*. Similarly, it is defined as the second adjustment traveling face 9*a* of the second adjustment member 9 that forms a traveling face continuous with the second body traveling face 42*a* being not only provided so that no gap S is present between the second body traveling face 42*a* and the second adjustment traveling face 9*a*, but may also be provided so that a gap S on which the article transport vehicle 1 can travel is provided between the second body traveling face 42*a* and the second adjustment traveling face 9*a*.

2. Second Embodiment

Next, the second embodiment of the article transport facility will be described with reference to FIG. 7. This embodiment differs from the first embodiment in the configuration of the adjustment mechanism MA, and this difference will be mainly described below. Note that this embodiment is the same as the first embodiment where no particular description is given.

Figure 7:
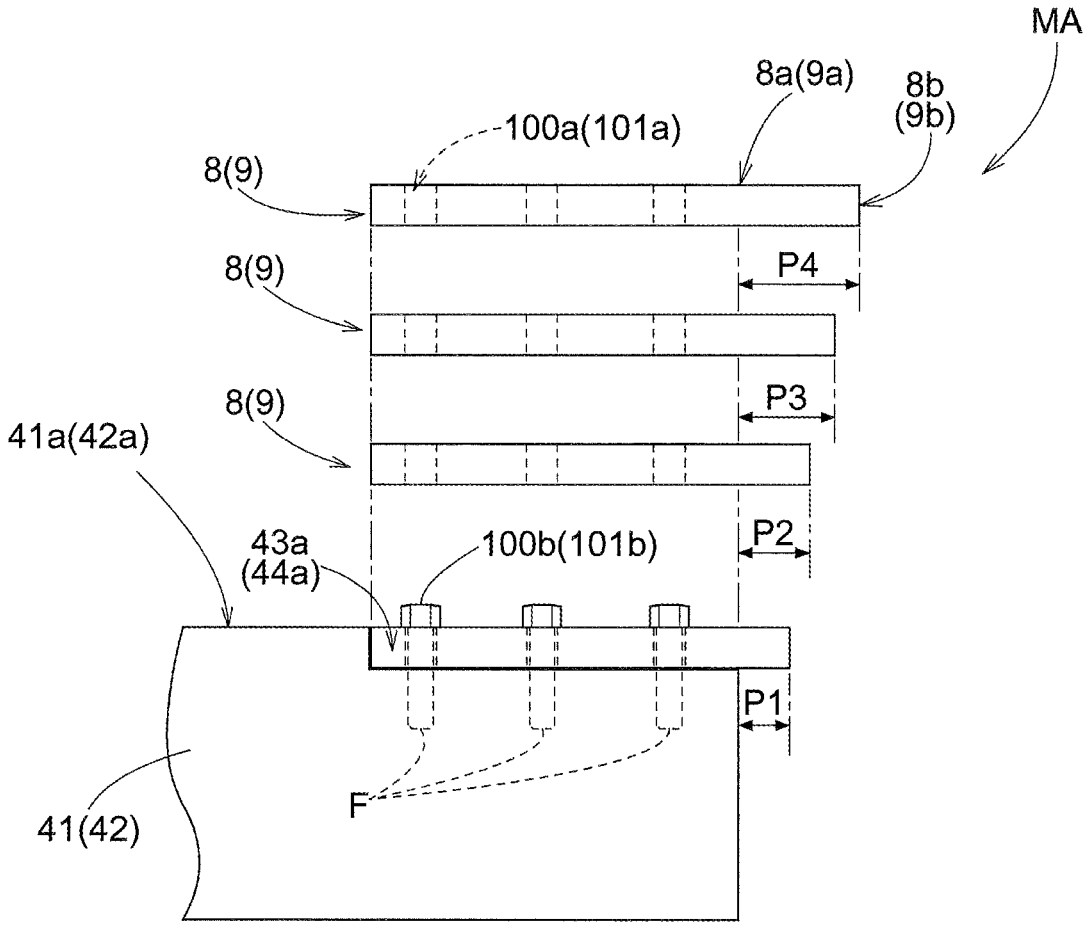
FIG. 7 is a side view according to a second embodiment.

As shown in FIG. 7, this embodiment is the same as the above-described embodiment in that both the first adjustment member 8 and the second adjustment member 9 are rectangular plate-shaped members with a fixed thickness, whereas this embodiment differs in that a plurality of types of plate-shaped members with different lengths in the longitudinal direction are used as first adjustment members 8 and second adjustment members 9. That is to say, a plurality of types of first adjustment members 8 have different protruding amounts P (P1<P2<P3<P4), i.e. first adjustment traveling faces 8*a* thereof protrude into the cut-off portion G2 by different amounts P. Also, a plurality of types of second adjustment members 9 have different protruding amounts P, i.e. second adjustment traveling faces 9*a* thereof protrude into the cut-off portion G2 by different amounts P. In this embodiment, the configuration of the plurality of types of second adjustment members 9 is the same as the configuration of the first adjustment members 8, and accordingly will not be shown in the diagrams.

The adjustment mechanism MA according to this embodiment includes the plurality of types of first adjustment members 8 that have different protruding amounts P, i.e. that have the first adjustment traveling faces 8*a* protruding into the cut-off portion G2 by different amounts P as mentioned above, the plurality of types of second adjustment members 9 that have different protruding amounts P, i.e. that have the second adjustment traveling faces 9*a* protruding into the cut-off portion G2 by different amounts P, a first fixing portion for detachably fixing any one of the plurality of types of first adjustment members 8 to the first recessed portion 43*a*, and a second fixing portion for detachably fixing any one of the plurality of types of second adjustment members 9 to the second recessed portion 44*a*.

The first fixing portion includes through-holes 100*a* that are provided in each of the first adjustment members 8, and fastening members 100*b*, such as bolts, that are inserted into the through-holes 100*a*. The second fixing portion includes through-holes 101*a* that are provided in each of the second adjustment members 9, and fastening members 101*b*, such as bolts, that are inserted into the through-holes 101*a*. In this embodiment, both the through-holes 100*a* in the first adjustment members 8 and the through-holes 101*a* in the second adjustment members 9 are not elongated holes but normal round holes.

One of the first adjustment members 8 is fastened and fixed to the first recessed portion 43*a* as a result of the fastening members 100*b* being inserted into the through-holes 100*a*, and a leading end portion of each fastening member 100*b* being threaded into a corresponding internal thread portion F of the first recessed portion 43*a*. Similarly, one of the second adjustment members 9 is fastened and fixed to the second recessed portion 44*a* as a result of the fastening members 101*b* being inserted into the elongated holes 101*a*, and a leading end portion of each fastening member 101*b* being threaded into a corresponding internal thread portion F of the second recessed portion 44*a*.

When the position of the gap portion G1 is changed, first, the fastening members 100*b* of the first fixing portion are removed, and thereafter, an originally-attached first adjustment member 8 is replaced with, for example, another first adjustment member 8 that has a longer first adjustment traveling face 8*a* and has a greater protruding amount P, and this newly-attached first adjustment member 8 is fixed to the first recessed portion 43*a*. Next, the fastening members 101*b* of the second fixing portion are removed, and thereafter, the originally-attached second adjustment member 9 is replaced with, for example, another adjustment member 9 that has a shorter second adjustment traveling face 9*a* and has a smaller protruding amount P, and this newly-attached second adjustment member 9 is fixed to the second recessed portion 44*a*. At this time, the first adjustment member 8 and the second adjustment member 9 are selected so that a relationship holds that is expressed as (the protruding amount P of the other first adjustment member 8−the protruding amount P of the originally-attached first adjustment member 8)=(the protruding amount P of the originally-attached second adjustment member 9−the protruding amount of the other second adjustment member 9). When the position of the gap portion G1 is adjusted in the opposite direction, the first adjustment member 8 is replaced with another first adjustment member 8 that has a smaller protruding amount P, and the second adjustment member 9 is replaced with another second adjustment member 9 that has a greater protruding amount P.

3. Third Embodiment

Figure 8:
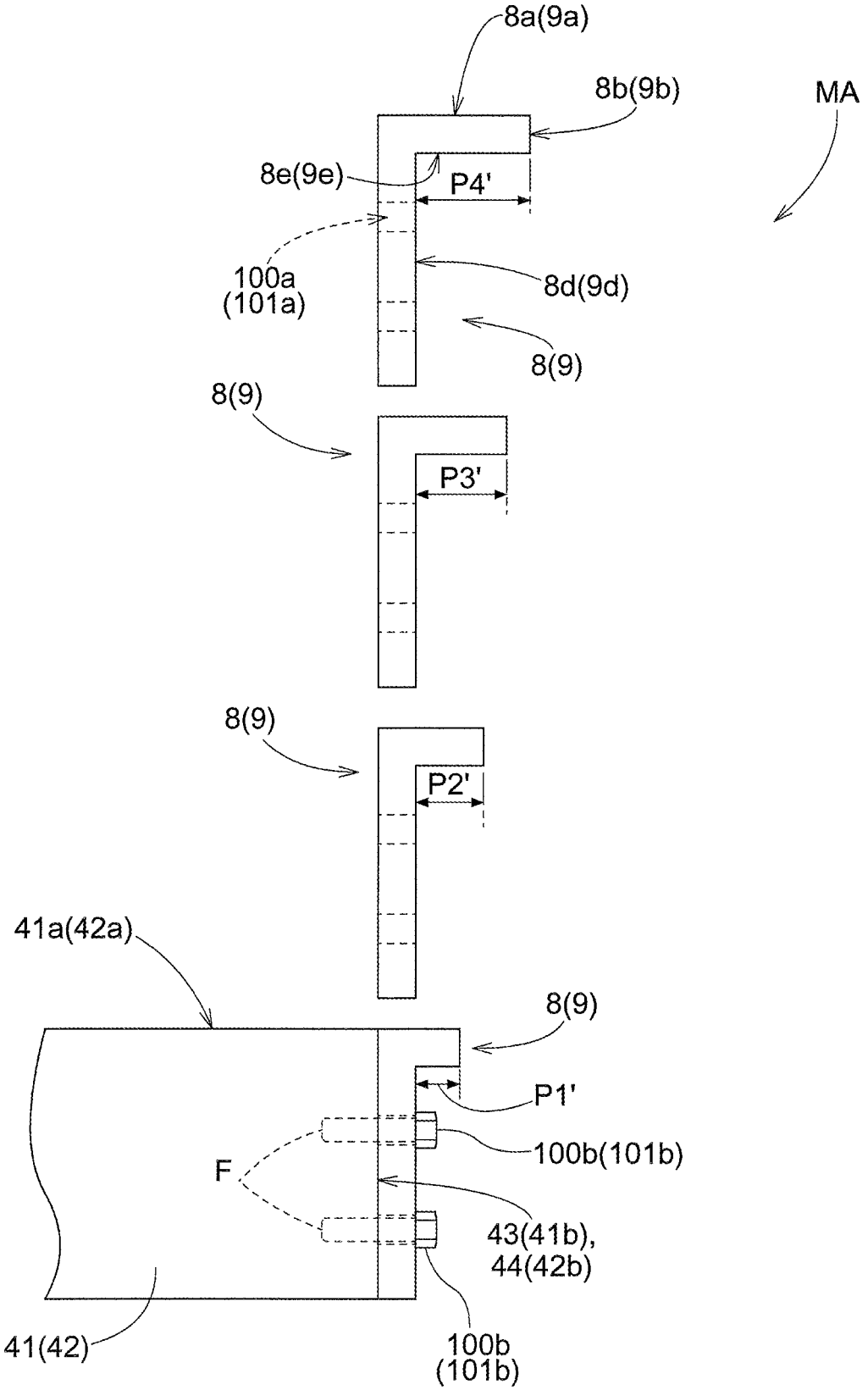
FIG. 8 is a side view according to a third embodiment.

The first adjustment members 8 and the second adjustment members 9 are not limited to those that are attached to the faces in which the traveling faces such as the first body traveling face 41*a* of the first rail body portion 41 and the second body traveling face 42*a* of the second rail body portion 42 are formed, and may alternatively be attached to other portions of the first rail body portion 41 and the second rail body portion 42. For example, as shown in FIG. 8, one of the first adjustment members 8 may be attached to the first end face 41*b* of the first rail body portion 41, and one of the second adjustment members 9 may be attached to the second end face 42*b* of the second rail body portion 42. In this case, the first adjustment members 8 and the second adjustment members 9 are not limited to the aforementioned plate-shaped members, and may alternatively be members that have an L-shaped vertical cross section. Here, each of the first adjustment members 8 has a base portion 8*d* and a protruding portion 8*e* that intersect each other at a right angle, and the difference in the length of the protruding portion 8*e* corresponds to the difference in the protruding amount P (P1'<P2'<P3'<P4'). An upper face of the protruding portion 8*e* of each first adjustment member 8 serves as the first adjustment traveling face 8*a*, and an end face of this protruding portion 8*e* in the direction parallel to the travel path L serves as the first adjustment end face 8*b*. Also, each of the second adjustment members 9 has a base portion 9*d* and a protruding portion 9*e* that intersect each other at a right angle, and the difference in the length of the protruding portion 9*e* corresponds to the difference in the protruding amount P (P1<P2'<P3'<P4'). An upper face of the protruding portion 9*e* of each second adjustment member 9 serves as the second adjustment traveling face 9*a*, and an end face of this protruding portion 9*e* in the direction parallel to the travel path L serves as the second adjustment end face 9*b*. Furthermore, in this embodiment, the first attachment portion 43 to which one of the first adjustment members 8 is attached is constituted by the first end face 41*b* of the first rail body portion 41, and the second attachment portion 44 to which one of the second adjustment members 9 is attached is constituted by the second end face 42*b* of the second rail body portion 42.

The adjustment mechanism MA according to this embodiment includes a plurality of types of first adjustment members 8 that have different protruding amounts P, i.e. that have the first adjustment traveling faces 8*a* protruding into the cut-off portion G2 by different amounts P as mentioned above, the plurality of types of second adjustment members 9 that have different protruding amounts P, i.e. that have the second adjustment traveling faces 9*a* protruding into the cut-off portion G2 by different amounts P, a first fixing portion for detachably fixing any one of the plurality of types of first adjustment members 8 to the first end face 41*b*, and a second fixing portion for detachably fixing any one of the plurality of types of second adjustment members 9 to the second end face 42*b*.

The first fixing portion includes through-holes 100*a* that are provided in the base portion 8*d* of each of the first adjustment members 8, and fastening members 100*b*, such as bolts, that are inserted into the through-holes 100*a*. The second fixing portion includes through-holes 101*a* that are provided in the base portion 9*d* of each of the second adjustment members 9, and fastening members 101*b*, such as bolts, that are inserted into the through-holes 101*a*. In this embodiment, both the through-holes 100*a* in the first adjustment members 8 and the through-holes 101*a* in the second adjustment members 9 are not elongated holes but normal round holes.

One of the first adjustment members 8 is fastened and fixed to the first end face 41*b* as a result of the fastening members 100*b* being inserted into the through-holes 100*a*, and a leading end portion of each fastening member 100*b* being threaded into a corresponding internal thread portion F of the first end face 41*b*. Similarly, one of the second adjustment members 9 is fastened and fixed to the second end face 42*b* as a result of the fastening members 101*b* being inserted into the through-holes 101*a*, and a leading end portion of each fastening member 101*b* being threaded into a corresponding internal thread portion F of the second end face 42*b*.

When the position of the gap portion G1 is changed, the first adjustment member 8 and the second adjustment member 9 are replaced with those with different lengths, similarly to the second embodiment. At this time, the first adjustment member 8 and the second adjustment member 9 are selected so that the amount by which the protruding amount P of the first adjustment member 8 increases (decreases) is the same as the amount by which the protruding amount P of the second adjustment member 9 decreases (increases).

According to the second and third embodiments, the position of the gap portion G1 can be freely adjusted by replacing the first adjustment member 8 for the first rail body portion 41 to adjust the protruding amount P of the first adjustment traveling face 8*a*, and replacing the second adjustment member 9 for the second rail body portion 42 to adjust the protruding amount P of the second adjustment traveling face 9*a*. Accordingly, the position of the gap portion G1 in the guide rail 4 through which the fire-proof door 7 passes can be adjusted readily and appropriately. In particular, according to the above embodiments, no gap needs to be provided between the first body traveling face 41*a* and the first adjustment traveling face 8*a* and between the second body traveling face 42*a* and the second adjustment traveling face 9*a*. Thus, the article transport vehicle 1 can travel more stably.

4. Fourth Embodiment

Figure 9:
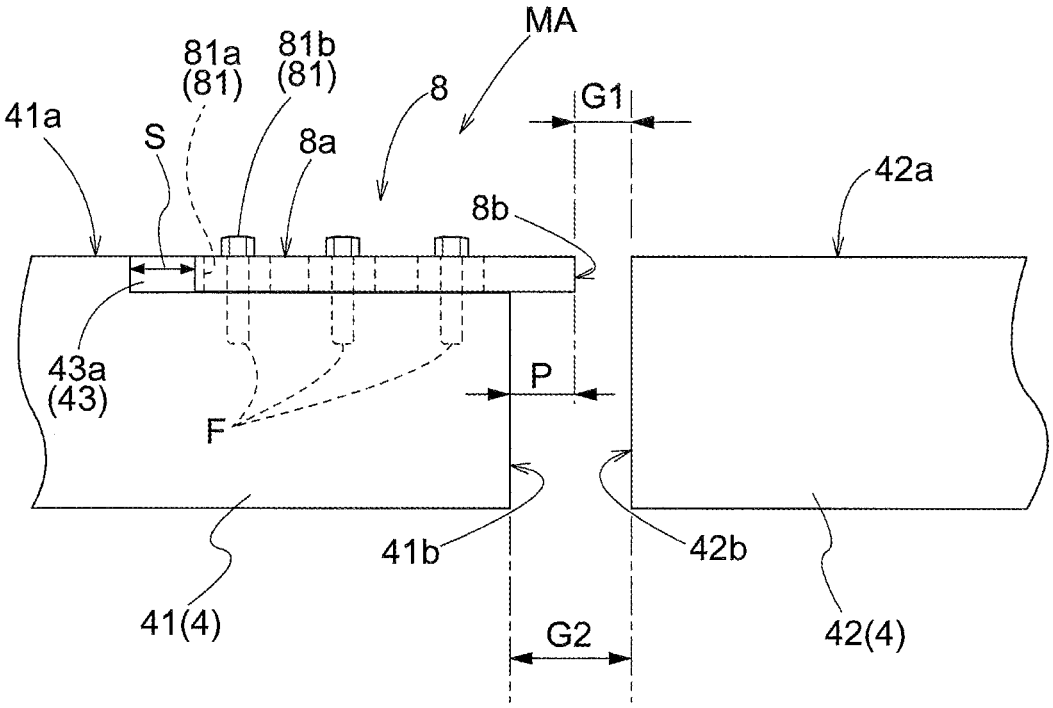
FIG. 9 is a side view according to a fourth embodiment.

In the first to third embodiments, only one of the first adjustment member 8 and the second adjustment member 9 may be provided. As an example, in this embodiment, the configuration on the first rail body portion 41 side includes the first adjustment member 8, similarly to the first embodiment, whereas the second adjustment member 9 is not provided on the second rail body portion 42 side, as shown in FIG. 9.

The first adjustment member 8 includes the first adjustment traveling face 8*a* that forms a traveling face continuous with the first body traveling face 41*a*, and the first adjustment end face 8*b* that faces the gap portion G1, similarly to the first embodiment. The first adjustment member 8 is arranged so that the first adjustment traveling face 8*a* protrudes, at least partially, into the cut-off portion G2 by a predetermined protruding amount P.

In this embodiment, the gap portion G1 across which the first adjustment end face 8*b* of the first adjustment member 8 and the second end face 42*b* of the second rail body portion 42 oppose each other corresponds to a "first gap". The cut-off portion G2 across which the first end face 41*b* of the first rail body portion 41 and the second end face 42*b* of the second rail body portion 42 oppose each other corresponds to a "second gap". The width of the cut-off portion G2 in the direction parallel to the travel path L is greater than the width of the gap portion G1 in the direction parallel to the travel path L. The fire-proof door 7, which has a plate shape, can pass through the gap portion G1. More specifically, the width of the gap portion G1 has a length that is obtained by adding a predetermined margin length to the thickness of the fire-proof door 7 in the direction parallel to the travel path L.

When the width of the gap portion G1 is changed by means of the function of the adjustment mechanism MA, the fastening of the fastening member 81*b* of the first position adjustment portion 81 is loosened, and thereafter, the protruding amount P relative to the cut-off portion G2 is changed by sliding the first adjustment member 8 in the direction parallel to the travel path L. Thereafter, the first adjustment member 8 is fixed by fastening the fastening members 81*b* again.

Accordingly, according to this embodiment, the width of the gap portion G1 across which the first adjustment member 8 and the second end face 42*b* of the second rail body portion 42 oppose each other can be freely adjusted by changing the protruding amount P of the first adjustment member 8, i.e. the amount P by which the first adjustment member 8 protrudes into the cut-off portion G2, using the adjustment mechanism MA. For this reason, the width of the gap portion G1 in the guide rails 4 through which the fire-proof door 7 passes can be readily adjusted without a need to change the positions of the first rail body portion 41 and the second rail body portion 42. In this embodiment, the width of the gap portion G1 is adjusted within an area that allows the fire-proof door 7 to move along the wall face of the wall body 2 and may ensure stable traveling of the article transport vehicle 1.

Although the first adjustment member 8 is provided in the above-described configuration, this may not always be the case. A configuration may also be employed in which the second adjustment member 9 is provided on the second rail body portion 42 side, similarly to the first embodiment, whereas the first adjustment member 8 is not provided on the first rail body portion 41 side. Also, the configuration of the first adjustment member 8 or the second adjustment member 9 according to this embodiment may be the same as that of the first adjustment member 8 or the second adjustment member 9 according to the second or third embodiment.

The configuration disclosed in any of the above embodiments can also be combined with the configuration disclosed in other embodiments, provided there is no inconsistency. As for other configurations as well, the embodiments disclosed in this specification are merely examples in all aspects. Accordingly, the present invention can be modified in various manners as appropriate without departing from the gist of the present disclosure.

5. Summary of the Above Embodiments

The summary of the above-described article transport facility will be described below.

An article transport facility includes:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein a first gap through which the fire-proof door can pass is provided in the guide rail, the guide rail includes a first rail body portion and a second rail body portion that are arranged separately on respective sides in a direction parallel to the travel path with a second gap therebetween, the second gap being larger than the first gap, and also includes a first adjustment member attached to the first rail body portion, and a second adjustment member attached to the second rail body portion, the first rail body portion includes a first body traveling face on which a traveling wheel of the article transport vehicle rolls, the second rail body portion includes a second body traveling face on which a traveling wheel of the article transport vehicle rolls, the first adjustment member includes a first adjustment traveling face forming a traveling face continuous with the first body traveling face, and is arranged so that the first adjustment traveling face at least partially protrudes into the second gap, the second adjustment member includes a second adjustment traveling face forming a traveling face continuous with the second body traveling face, and is arranged so that the second adjustment traveling face at least partially protrudes into the second gap, a gap across which the first adjustment member and the second adjustment member oppose each other is the first gap, and an adjustment mechanism capable of changing the position of the first gap in the direction parallel to the travel path is provided.

With this configuration, the gap across which the first rail body portion and the second rail body portion oppose each other is the second gap that is larger than the first gap through which the fire-proof door passes, and the position of the first gap can be changed in the direction parallel to the travel path within the area of the second gap by the adjustment mechanism. Since this adjustment using the adjustment mechanism is an adjustment of the position of the gap across which the first adjustment member and the second adjustment member oppose each other, the positions of the first rail body portion and the second rail body portion do not need to be moved. Accordingly, the position of the first gap in the guide rail through which the fire-proof door passes can be readily adjusted. Also, since the first adjustment traveling face of the first adjustment member and the second adjustment traveling face of the second adjustment member are arranged protruding into the second gap, the gap in the traveling face of the guide rail at the portion of the first gap can be made relatively small. Accordingly, it is possible to suppress the occurrence of vibrations and impacts when the article transport vehicle passes through the portion of the first gap, without preventing movement of the fire-proof door.

Here, it is favorable that the first rail body portion includes a first attachment portion to which the first adjustment member is attached, the second rail body portion includes a second attachment portion to which the second adjustment member is attached, and the adjustment mechanism includes a first position adjustment portion capable of changing the position at which the first adjustment member is attached to the first attachment portion, and a second position adjustment portion capable of changing the position at which the second adjustment member is attached to the second attachment portion.

With this configuration, the position of the first gap can be freely adjusted by changing the position at which the first adjustment member is attached to the first rail body portion and the position at which the second adjustment member is attached to the second rail body portion. Accordingly, the position of the first gap in the guide rail through which the fire-proof door passes can be readily and appropriately adjusted.

It is favorable that the first rail body portion includes a first attachment portion to which the first adjustment member is attached, the second rail body portion includes a second attachment portion to which the second adjustment member is attached, and the adjustment mechanism includes: a first fixing portion configured to detachably fix, to the first attachment portion, any one of a plurality of types of the first adjustment members, each having the first adjustment traveling face that protrudes into the second gap by a different protruding amount, and a second fixing portion configured to detachably fix, to the second attachment portion, any one of a plurality of types of the second adjustment members, each having the second adjustment traveling face that protrudes into the second gap by a different protruding amount.

With this configuration, the position of the first gap can be freely adjusted by replacing the first adjustment member for the first rail body portion to adjust the protruding amount of the first adjustment traveling face, and replacing the second adjustment member for the second rail body portion to adjust the protruding amount of the second adjustment traveling face. Accordingly, the position of the first gap in the guide rail through which the fire-proof door passes can be readily and appropriately adjusted.

It is favorable that each of the first adjustment member and the second adjustment member is a plate-shaped member with a fixed thickness, the first attachment portion includes a first recessed portion that is formed in a face of the first rail body portion, the face forming the first body traveling face, the second attachment portion includes a second recessed portion that is formed in a face of the second rail body portion, the face forming the second body traveling face, the first recessed portion is open toward the second gap, and the depth of the first recessed portion from the first body traveling face is the same as the thickness of the first adjustment member, the second recessed portion is open toward the second gap, and the depth of the second recessed portion from the second body traveling face is the same as the thickness of the second adjustment member, the first adjustment member is arranged within the first recessed portion so that the first adjustment member partially protrudes into the second gap, and so that the first adjustment traveling face is located in the same plane as that of the first body traveling face, and the second adjustment member is arranged within the second recessed portion so that the second adjustment member partially protrudes into the second gap, and so that the second adjustment traveling face is located in the same plane as that of the second body traveling face.

With this configuration, the first adjustment traveling face of the first adjustment member is located in the same plane as that of the first body traveling face, and the second adjustment traveling face of the second adjustment member is located in the same plane as that of the second body traveling face. It is thus possible to suppress the occurrence of vibrations and impacts when the article transport vehicle travels on the traveling faces of the first adjustment member and the second adjustment member. Also, since the first adjustment member and the second adjustment member are plate-shaped members that have a fixed thickness, and are arranged in the recessed portions that are open toward the second gap, it is possible to stably attach the first adjustment member and the second adjustment member to the rail body portions, and readily adjust the position of the first gap.

An article transport facility includes:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein a first gap through which the fire-proof door can pass is provided in the guide rail, the guide rail includes a first rail body portion and a second rail body portion that are arranged separately on respective sides in a direction parallel to the travel path with a second gap therebetween, the second gap being larger than the first gap, and also includes a first adjustment member attached to the first rail body portion, the first rail body portion includes a first body traveling face on which a traveling wheel of the article transport vehicle rolls, the second rail body portion includes a second body traveling face on which a traveling wheel of the article transport vehicle rolls, the first adjustment member includes a first adjustment traveling face forming a traveling face continuous with the first body traveling face, and is arranged so that the first adjustment traveling face at least partially protrudes into the second gap, a gap across which the first adjustment member and the second rail body portion oppose each other is the first gap, and an adjustment mechanism capable of changing the width of the first gap in the direction parallel to the travel path is provided.

With this configuration, the gap across which the first rail body portion and the second rail body portion oppose each other is the second gap that is larger than the first gap through which the fire-proof door passes, and the width of the first gap can be changed in the direction parallel to the travel path within the area of the second gap by the adjustment mechanism. Since this adjustment using the adjustment mechanism is an adjustment of the width of the gap across which the first adjustment member and the second rail body portion oppose each other, the position of the first rail body portion does not need to be moved. Accordingly, the width of the first gap in the guide rail through which the fire-proof door passes can be readily adjusted. Also, since the first adjustment traveling face of the first adjustment member is arranged protruding into the second gap, the gap in the traveling face of the guide rail at the portion of the first gap can be made relatively small. Accordingly, it is possible to suppress the occurrence of vibrations and impacts when the article transport vehicle passes through the portion of the first gap, without preventing movement of the fire-proof door.

INDUSTRIAL APPLICABILITY

The technique according to the present disclosure can be used in an article transport facility that includes an article transport vehicle that travels along a travel path passing through an opening portion formed in a wall body, a guide rail for guiding the article transport vehicle along the travel path, and a fire-proof door for closing the opening portion by moving in a direction parallel to a wall face of the wall body.

What is claimed is:

1. An article transport facility comprising:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein:

a first gap through which the fire-proof door can pass is provided in the guide rail, the guide rail comprises a first rail body portion and a second rail body portion that are arranged separately on respective sides in a direction parallel to the travel path with a second gap therebetween, the second gap being larger than the first gap, and also comprises a first adjustment member attached to the first rail body portion, and a second adjustment member attached to the second rail body portion, the first rail body portion comprises a first body traveling face on which a traveling wheel of the article transport vehicle rolls, the second rail body portion comprises a second body traveling face on which a traveling wheel of the article transport vehicle rolls, the first adjustment member comprises a first adjustment traveling face forming a traveling face continuous with the first body traveling face, and is arranged so that the first adjustment traveling face at least partially protrudes into the second gap, the second adjustment member comprises a second adjustment traveling face forming a traveling face continuous with the second body traveling face, and is arranged so that the second adjustment traveling face at least partially protrudes into the second gap, a gap across which the first adjustment member and the second adjustment member oppose each other is the first gap, and an adjustment mechanism capable of changing the position of the first gap in the direction parallel to the travel path is provided.

2. The article transport facility according to claim 1, wherein:

the first rail body portion comprises a first attachment portion to which the first adjustment member is attached, the second rail body portion comprises a second attachment portion to which the second adjustment member is attached, and the adjustment mechanism includes a first position adjustment portion capable of changing the position at which the first adjustment member is attached to the first attachment portion, and a second position adjustment portion capable of changing the position at which the second adjustment member is attached to the second attachment portion.

3. The article transport facility according to claim 2, wherein:

each of the first adjustment member and the second adjustment member is a plate-shaped member with a fixed thickness, the first attachment portion comprises a first recessed portion that is formed in a face of the first rail body portion, the face forming the first body traveling face, and the second attachment portion comprises a second recessed portion that is formed in a face of the second rail body portion, the face forming the second body traveling face, the first recessed portion is open toward the second gap, and the depth of the first recessed portion from the first body traveling face is the same as the thickness of the first adjustment member, the second recessed portion is open toward the second gap, and the depth of the second recessed portion from the second body traveling face is the same as the thickness of the second adjustment member, the first adjustment member is arranged within the first recessed portion so that the first adjustment member partially protrudes into the second gap, and so that the first adjustment traveling face is located in the same plane as that of the first body traveling face, and the second adjustment member is arranged within the second recessed portion so that the second adjustment member partially protrudes into the second gap, and so that the second adjustment traveling face is located in the same plane as that of the second body traveling face.

4. The article transport facility according to claim 3, wherein:

the first recessed portion is open in the face in which the first body traveling face is formed, and the second recessed portion is open in the face in which the second body traveling face is formed.

5. The article transport facility according to claim 4, wherein:

the first position adjustment portion includes at least one first elongated hole provided in the first adjustment member and a first fastening member, the first elongated hole penetrates the first adjustment member in a thickness direction thereof and has a dimension in a direction along the travel path that is greater than a dimension in a direction perpendicular to both the direction along the travel path and the thickness direction, the first recessed portion has a first internal thread portion formed therein, into which the first fastening member is screwable, the first adjustment member is fastened and fixed to the first recessed portion by the fastening member being inserted into the first elongated hole and screwed into the first internal thread portion, the second position adjustment portion includes at least one second elongated hole provided in the second adjustment member and a second fastening member, the second elongated hole penetrates the second adjustment member in a thickness direction thereof and has a dimension in the direction along the travel path that is greater than a dimension in a direction perpendicular to both the direction along the travel path and the thickness direction, the second recessed portion has a second internal thread portion formed therein, into which the second fastening member is screwable, and the second adjustment member is fastened and fixed to the first recessed portion by the fastening member being inserted into the second elongated hole and screwed into the second internal thread portion.

6. The article transport facility according to claim 1, wherein:

the first rail body portion comprises a first attachment portion to which the first adjustment member is attached, the second rail body portion comprises a second attachment portion to which the second adjustment member is attached, and the adjustment mechanism includes:

a first fixing portion configured to detachably fix, to the first attachment portion, any one of a plurality of types of the first adjustment members, each having the first adjustment traveling face that protrudes into the second gap by a different protruding amount; and a second fixing portion configured to detachably fix, to the second attachment portion, any one of a plurality of types of the second adjustment members, each having the second adjustment traveling face that protrudes into the second gap by a different protruding amount.

7. The article transport facility according to claim 6, wherein:

each of the first adjustment member and the second adjustment member is a plate-shaped member with a fixed thickness, the first attachment portion comprises a first recessed portion that is formed in a face of the first rail body portion, the face forming the first body traveling face, the second attachment portion comprises a second recessed portion that is formed in a face of the second rail body portion, the face forming the second body traveling face, the first recessed portion is open toward the second gap, and the depth of the first recessed portion from the first body traveling face is the same as the thickness of the first adjustment member, the second recessed portion is open toward the second gap, and the depth of the second recessed portion from the second body traveling face is the same as the thickness of the second adjustment member, the first adjustment member is arranged within the first recessed portion so that the first adjustment member partially protrudes into the second gap, and so that the first adjustment traveling face is located in the same plane as that of the first body traveling face, and the second adjustment member is arranged within the second recessed portion so that the second adjustment member partially protrudes into the second gap, and so that the second adjustment traveling face is located in the same plane as that of the second body traveling face.

8. The article transport facility according to claim 7, wherein:

the first recessed portion is open in the face in which the first body traveling face is formed, and the second recessed portion is open in the face in which the second body traveling face is formed.

9. The article transport facility according to claim 8, wherein:

the first fixing portion includes at least one first through-hole provided in the first adjustment member and a third fastening member, the first recessed portion has a third internal thread portion formed therein, into which the third fastening member is screwable, the first adjustment member is fastened and fixed to the first recessed portion by the third fastening member being inserted into the first through-hole and screwed into the third internal thread portion, the second fixing portion includes at least one second through-hole provided in the second adjustment member and a fourth fastening member, the second recessed portion has a fourth internal thread portion formed therein, into which the fourth fastening member is screwable, and the second adjustment member is fastened and fixed to the second recessed portion by the fourth fastening member being inserted into the second through-hole and screwed into the fourth internal thread portion.

10. An article transport facility comprising:

an article transport vehicle configured to travel along a travel path passing through an opening portion formed in a wall body;

a guide rail configured to guide the article transport vehicle along the travel path; and a fire-proof door configured to close the opening portion by moving in a direction parallel to a wall face of the wall body, wherein:

a first gap through which the fire-proof door can pass is provided in the guide rail, the guide rail comprises a first rail body portion and a second rail body portion that are arranged separately on respective sides in a direction parallel to the travel path with a second gap therebetween, the second gap being larger than the first gap, and also comprises a first adjustment member attached to the first rail body portion, the first rail body portion comprises a first body traveling face on which a traveling wheel of the article transport vehicle rolls, the second rail body portion comprises a second body traveling face on which a traveling wheel of the article transport vehicle rolls, the first adjustment member comprises a first adjustment traveling face forming a traveling face continuous with the first body traveling face, and is arranged so that the first adjustment traveling face at least partially protrudes into the second gap, a gap across which the first adjustment member and the second rail body portion oppose each other is the first gap, and an adjustment mechanism capable of changing the width of the first gap in the direction parallel to the travel path is provided.

11. The article transport facility according to claim 10, wherein:

wherein the first rail body portion comprises a first attachment portion to which the first adjustment member is attached, and the adjustment mechanism includes a first position adjustment portion capable of changing the position at which the first adjustment member is attached to the first attachment portion.

12. The article transport facility according to claim 11, wherein:

the first adjustment member is a plate-shaped member with a fixed thickness, the first attachment portion comprises a first recessed portion that is formed in a face of the first rail body portion, the face forming the first body traveling face, the first recessed portion is open toward the second gap, and the depth of the first recessed portion from the first body traveling face is the same as the thickness of the first adjustment member, and the first adjustment member is arranged within the first recessed portion so that the first adjustment member partially protrudes into the second gap, and so that the first adjustment traveling face is located in the same plane as that of the first body traveling face.

13. The article transport facility according to claim 10, wherein:

the first rail body portion comprises a first attachment portion to which the first adjustment member is attached, and the adjustment mechanism includes: a first fixing portion configured to detachably fix, to the first attachment portion, any one of a plurality of types of the first adjustment members, each having the first adjustment traveling face that protrudes into the second gap by a different protruding amount.

14. The article transport facility according to claim 13, wherein:

the first adjustment member is a plate-shaped member with a fixed thickness, the first attachment portion comprises a first recessed portion that is formed in a face of the first rail body portion, the face forming the first body traveling face, the first recessed portion is open toward the second gap, and the depth of the first recessed portion from the first body traveling face is the same as the thickness of the first adjustment member, and the first adjustment member is arranged within the first recessed portion so that the first adjustment member partially protrudes into the second gap, and so that the first adjustment traveling face is located in the same plane as that of the first body traveling face.

15. The article transport facility according to claim 14, wherein the first recessed portion is open in the face in which the first body traveling face is formed.

16. The article transport facility according to claim 15, wherein the first recessed portion is open in the face in which the first body traveling face is formed.

17. The article transport facility according to claim 16, wherein:

the first position adjustment portion includes at least one first elongated hole provided in the first adjustment member and a first fastening member, the first elongated hole penetrates the first adjustment member in a thickness direction thereof and has a dimension in a direction along the travel path that is greater than a dimension in a direction perpendicular to both the direction along the travel path and the thickness direction, the first recessed portion has a first internal thread portion formed therein, into which the first fastening member is screwable, and the first adjustment member is fastened and fixed to the first recessed portion by the fastening member being inserted into the first elongated hole and screwed into the first internal thread portion.

18. The article transport facility according to claim 15, wherein:

the first fixing portion includes at least one first through-hole provided in the first adjustment member and a third fastening member, the first recessed portion has a third internal thread portion formed therein, into which the third fastening member is screwable, and the first adjustment member is fastened and fixed to the first recessed portion by the third fastening member being inserted into the first through-hole and screwed into the third internal thread portion.

* * * * *